US009017047B2

(12) United States Patent
Wireman

(10) Patent No.: US 9,017,047 B2
(45) Date of Patent: Apr. 28, 2015

(54) MULTI-LAYER PRIMER APPARATUS AND METHODS

(75) Inventor: Justin McCord Wireman, Comstock Park, MI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 13/036,769

(22) Filed: Feb. 28, 2011

(65) Prior Publication Data

US 2012/0067316 A1 Mar. 22, 2012

Related U.S. Application Data

(63) Continuation of application No. 12/885,195, filed on Sep. 17, 2010, now abandoned.

(51) Int. Cl.
*F04B 43/08* (2006.01)
*F02M 1/16* (2006.01)

(52) U.S. Cl.
CPC ..... *F02M 1/16* (2013.01)

(58) Field of Classification Search
USPC ..... 417/478; 92/90–92; 123/179.11
See application file for complete search history.

(56) References Cited

U.S. PATENT DOCUMENTS

| | | | | | |
|---|---|---|---|---|---|
| 247,142 | A | | 9/1881 | Woods | |
| 3,009,459 | A | * | 11/1961 | Ruben | 128/205.13 |
| 3,158,104 | A | * | 11/1964 | Hutchinson | 210/416.2 |
| 3,255,677 | A | * | 6/1966 | Hesse | 92/90 |
| 3,349,716 | A | * | 10/1967 | Weber | 417/478 |
| 3,987,775 | A | * | 10/1976 | O'Connor | 123/179.11 |
| 4,532,923 | A | | 8/1985 | Flynn | |
| 4,564,662 | A | * | 1/1986 | Albin | 526/247 |
| 5,970,935 | A | | 10/1999 | Harvey et al. | |
| 6,019,890 | A | | 2/2000 | Janik et al. | |
| 6,655,414 | B2 | * | 12/2003 | Nishi et al. | 138/137 |
| 7,011,114 | B2 | * | 3/2006 | Suzuki et al. | 138/137 |
| 7,021,195 | B2 | * | 4/2006 | Proust | 92/92 |
| 7,415,997 | B2 | | 8/2008 | Cisternino et al. | |
| 7,484,942 | B2 | * | 2/2009 | Proust | 417/478 |
| 2011/0088648 | A1 | | 4/2011 | Brown et al. | |

(Continued)

OTHER PUBLICATIONS

The United States Patent and Trademark Office, "Restriction Requirement," issued in connection with U.S. Appl. No. 12/885,195, on Dec. 6, 2012 (7 pages).
The United States Patent and Trademark Office, "Non-Final Office Action," issued in connection with U.S. Appl. No. 12/885,195, on Feb. 4, 2013 (11 pages).
The United States Patent and Trademark Office, "Non-Final Office Action," issued in connection with U.S. Appl. No. 12/885,195, on Aug. 29, 2013 (9 pages).

(Continued)

*Primary Examiner* — Christopher Bobish
(74) *Attorney, Agent, or Firm* — Hanley, Flight & Zimmerman, LLC

(57) ABSTRACT

Primer apparatus and methods are described herein. An example primer apparatus includes a flexible body defining an internal chamber to be fluidly coupled to a fuel system. The body includes a first layer material having a low permeation characteristic to substantially prevent diurnal emissions from escaping the fuel system, a second layer material adjacent the first layer material having a relatively high resiliency compared to the first layer material to enable the body to return to an uncompressed shape when the body is deflected and released by a user, and a third layer material adjacent to the first layer material such that the first layer material is disposed between the second layer material and the third layer material and having a relatively high resiliency compared to the first layer material to enable the body to return to the uncompressed shape when the body is deflected and released by the user.

30 Claims, 6 Drawing Sheets

(56) References Cited

U.S. PATENT DOCUMENTS

| | | | | |
|---|---|---|---|---|
| 2011/0240153 | A1* | 10/2011 | Podesta et al. | 137/565.25 |
| 2012/0042844 | A1* | 2/2012 | Chiang | 123/179.11 |

OTHER PUBLICATIONS

The United States Patent and Trademark Office, "Final Office Action," issued in connection with U.S. Appl. No. 12/885,195, on Feb. 28, 2014 (12 pages).

* cited by examiner

MULTI-LAYER PRIMER APPARATUS AND METHODS

RELATED U.S. APPLICATION DATA

This application is a continuation-in-part of U.S. patent application Ser. No. 12/885,195, which was filed on Sep. 17, 2010 and which is incorporated by reference herein in its entirety.

FIELD OF THE DISCLOSURE

The present disclosure relates generally to fuel primer apparatus and, more particularly, to multi-layer primer apparatus and methods.

BACKGROUND

Government agencies (e.g., the Environmental Protection Agency) have enacted regulations to limit the amount of evaporative emissions emitted by boats and other marine vehicles during operation and/or non-operation. More specifically, government regulations (e.g., Title 40 of the Code of Federal Regulations) have been enacted toward controlling diurnal evaporative emissions of marine vehicles. In particular, these regulations limit the amount of evaporative diurnal emissions that a marine vehicle may permissibly emit during a diurnal cycle (e.g., periods of non-operation).

During non-operation of a marine vehicle, for example, a fuel delivery system of the vehicle may be subjected to daily ambient temperature changes that may cause the release of hydrocarbons to the environment. Such emissions are commonly referred to as diurnal emissions and are considered hazardous to the environment. Often, vapor leakage is exacerbated by diurnal temperature cycles. For example, fuel leakage or emission of vapors may occur via permeation through various couplings of the fuel delivery system components. One such coupling may be a primer bulb or apparatus of the fuel system. When the pressure in the fuel tank increases during a diurnal cycle, the fuel vapors may fill the fuel line and may leak or escape to the environment via permeation through conventional or known primer apparatus.

DETAILED DESCRIPTION

In general, the example primer apparatus described herein may be used with marine crafts or vehicles and substantially reduce or prevent diurnal emissions through the primer apparatus. For example, an example primer apparatus described herein includes enhanced or improved evaporative emission control to substantially reduce diurnal emissions through a body of the primer apparatus. Additionally, the example primer apparatus is resilient to enable the body of the primer apparatus to return to its original shape when the body is deflected or compressed by a user and/or to prevent the primer apparatus from deforming or otherwise becoming inoperable due to deformation or damage that may be caused by temperature fluctuations.

In some examples, the example primer apparatus described herein is a multi-layer or dual layer primer apparatus. For example, the primer apparatus may include a body composed of a first or insert material having low permeation characteristics or rates to substantially reduce permeation of fuel vapor emissions via the primer apparatus when the primer apparatus is coupled to a fuel delivery system. For example, a primer apparatus described herein allows less than about 15 $g/m^2$/day of permeated emissions. Additionally, the body may also include a second material or layer having relatively high strength and/or resiliency to enable the body to return to its original form or shape after a user deflects and releases the body. Further, the second material provides structural stability to prevent the primer apparatus from becoming deformed due to, for example, temperature fluctuations. Additionally, the body may also include a third material or layer such that the first layer is captured between the second and third layers. Similar to the second layer, the third layer may have a relatively high strength and/or resiliency to further enable the body to return to its original form or shape after a user deflects and releases the body.

As used herein, the term "fluid" includes, but is not limited to, a liquid such as fuel (e.g., gasoline), a vapor such as fuel vapor (e.g., gasoline vapor), a gas (e.g., air) and/or any combination or mixture thereof.

Figure 1A:
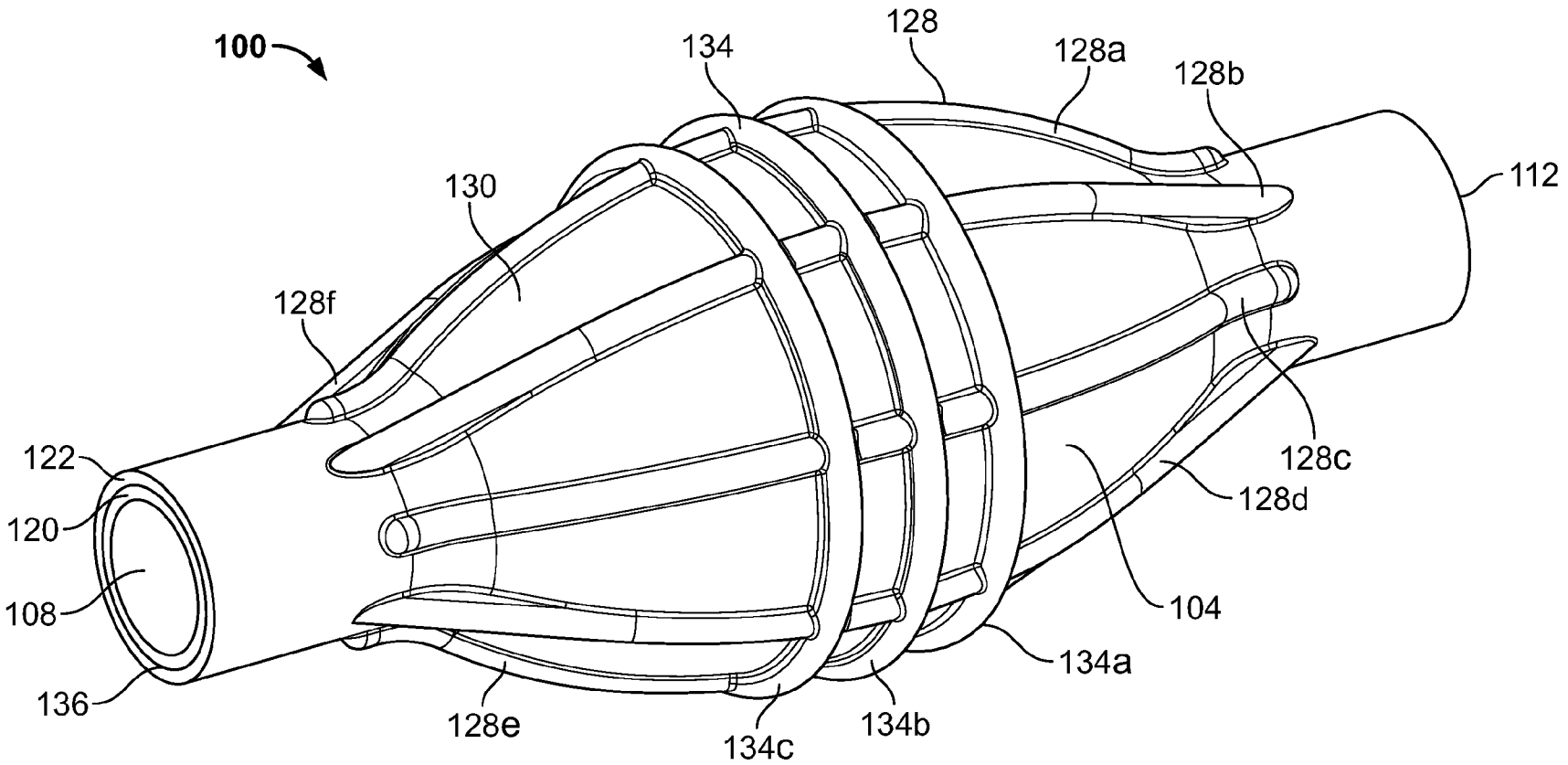
FIG. 1A illustrates an example primer apparatus described herein.

FIG. 1A illustrates an example primer apparatus 100 described herein.

Figure 1B:
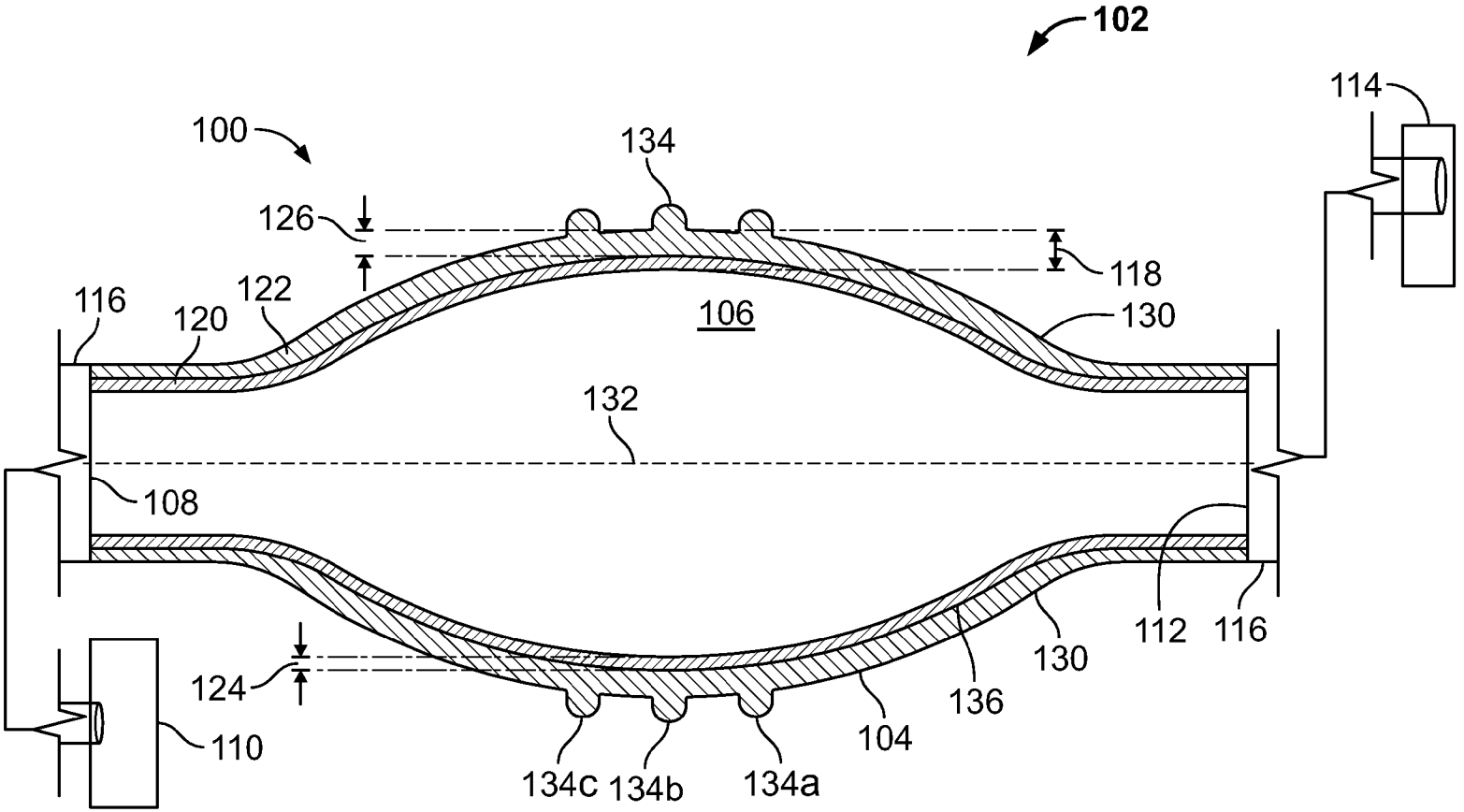
FIG. 1B illustrates a cross-sectional view of the example primer apparatus of FIG. 1A coupled to an example fuel system.

FIG. 1B illustrates a cross-sectional view of the example primer apparatus 100 of FIG. 1A implemented with a fuel system 102 (e.g., a marine fuel delivery system). Referring to FIGS. 1A and 1B, the example primer apparatus 100 is a multi-layer primer apparatus. In this example, the primer apparatus 100 includes a body 104 (e.g., a flexible body) to define or form a pumping or inner chamber 106. An inlet or first side 108 of the body 104 is in fluid communication with, for example, a fuel tank 110 upstream from the primer apparatus 100 and an outlet or second side 112 of the body 104 is in fluid communication with, for example, downstream equipment 114 such as an intake system of an engine (e.g., a marine engine). The inlet 108 and/or the outlet 112 may receive a fuel line or conduit 116, which can be coupled to the body 104 at the inlet 108 and the outlet 112 via, for example, friction fit, a ring clamp, a band clamp, or any other fastener.

Additionally, although not shown, the inlet 108 and/or the outlet 112 may include a fluid flow control device such as, for example, a check valve. For example, an inlet check valve (not shown) may be coupled to the inlet 108 to control fluid flow to the inner chamber 106 while preventing fluid flow from the inner chamber 106 to the inlet 108. Similarly, the outlet 112 may include an outlet check valve (not shown) to control fluid flow from the inner chamber 106 to the downstream equipment 114 while preventing fluid flow into the inner chamber 106 via the outlet 112 (e.g., prevents a reverse fluid flow).

In this example, the primer apparatus 100 or body 104 includes at least a dual layer body to define the inner chamber 106. In this example, the body 104 defines an oblong or elliptically-shape profile and is flexible. In other examples, the body 104 may have a tubular shape, a spherical shape or any other shape to form or define the inner chamber 106. An overall thickness 118 of the body 104 may be, for example, between about 0.100 inches and 0.300 inches. In this example, the body 104 has a thickness 118 of about 0.180 inches. A body having, for example, a relatively greater thickness may be better suited for use in environments having relatively warm temperatures while a body having a relatively smaller thickness may be better suited for use in environments having relatively colder temperatures. More specifically, a relatively thinner body would remain flexible and thus, is easier to squeeze or deflect in colder environments.

As shown in this example, the body 104 includes a first or inner layer material 120 that may be coupled to, disposed within, embedded with and/or layered with a second or outer layer material 122. The first layer material 120 is composed of a material having low permeation characteristics and the second layer material 122 is composed of a material having relatively high strength and/or resiliency. For example, the first layer material 120 may include, but is not limited to, a fluoroelastomer material (e.g., a Fluorocarbon (FKM)), a fluoropolymer material (e.g., polytetrafluoroethylene), a nylon material, Acetal, a copolymer material (e.g., Ethylene Vinyl Alcohol) or any other material providing relatively low permeation characteristics (e.g., a permeation rate less than about 15 g/m$^2$/day when exposed to temperatures between about 69° F. and 77° F. The second layer material 122, for example, may include, but is not limited to, a halogenated elastomeric material such as ECO, a Nitrile material, a rubber material, a plastic material, or any other material that provides relatively high strength and/or resiliency.

As shown, the second layer material 122 substantially surrounds (e.g., completely surrounds) the first layer material 120. The first layer material 120 may have a thickness 124 of between about 0.030 inches and 0.150 inches. In this particular example, the first layer material 120 has a thickness 124 of about 0.050 inches. The second layer material 122 may have a thickness 126 of between about 0.050 inches and 0.150 inches. In this particular example, the second layer material 122 has a thickness 126 of about 0.130 inches.

To provide additional structural support and/or strength to the body 104, the body 104 may include at least one rib 128 disposed on an outer surface 130 of the body 104 (i.e., an outer surface of the second layer material 122) that is substantially parallel or at an angle relative a longitudinal axis 132 of the body 104 and/or the body 104 may include at least one rib 134 on the outer surface 130 of the body 104 that is substantially perpendicular or at an angle relative to the longitudinal axis 132 and/or the rib 128. As shown, the example body 104 includes a first plurality of ribs 128*a-f* and a second plurality of ribs 134*a-c* along the outer surface 130 of the body 104.

Additionally or alternatively, an adhesive or bonding agent 136 may be disposed between the first layer material 120 and the second layer material 122 to facilitate adhesion between the different layers of material 120 and 122. For example, adhesion between the first and second layer materials 120 and 122 may be achieved via chemical or adhesion bonding by including an adhesive material or agent between the first and second layer materials 120 and 122.

In operation, volumetric changes (e.g., expansion) in the fuel tank 110 may cause pressure differentials within the fuel tank 110. For example, when the pressure of fuel and/or vapors in the fuel tank 110 increases, fuel vapors are released from the fuel tank 110 through the fuel system 102 (e.g., via the hose 116). In other words, an increase in pressure in the fuel tank 110 causes fuel vapors (e.g., containing hydrocarbons) in the fuel tank 110 to release or travel through fuel line 116 of the fuel system 102.

For example, during non-operation of a marine vehicle, the fuel system 102 may be subjected to daily ambient temperature changes that may cause or affect the pressure of the fuel and/or fuel vapors within the fuel system 102 (e.g., during diurnal temperature cycles). Diurnal emissions are evaporative emissions that are released due to daily temperature changes or cycles that may cause liquid fuel to become fuel vapor during the daylight hours and condensing fuel vapors to liquid during the night hours. More specifically, during a diurnal cycle, the temperature of the air decreases during the night hours, causing the pressure of the fuel and/or fuel vapors in the fuel tank 110 to decrease. When the pressure decreases, air is drawn into the fuel tank 110, which mixes with the fuel vapors. During the daylight hours, the temperature of the air may increase causing the pressure of the fuel and/or vapors in the fuel tank 110 to increase. Such an increase in pressure causes fuel leakage or emission of fuel vapors via the fuel system 102. As a result, the pressure cycling that occurs in response to such temperature changes causes the release of hydrocarbons from the fuel tank 110 to the environment via, for example, conventional or known primer apparatus or bulbs. For example, an increase in fuel tank pressure may cause the release of hydrocarbons or gasoline to travel to the primer apparatus and to the environment via the fuel line 116. Thus, known primer apparatus may not be in compliance with certain government standards if these apparatus fail to substantially restrict or prevent permeation of fuel vapors. For example, a known primer bulb is typically composed of materials that lack low permeation characteristics. On the other hand, a primer apparatus composed entirely of a low permeation material significantly increases the cost of a primer apparatus and such low permeation materials often lack sufficient resiliency, thereby causing the primer apparatus to deform or set from its original shape and become inoperable after a relatively small number of repeated deflections particularly at lower temperatures.

In contrast to known primer apparatus, the example primer apparatus 100 of FIG. 1 significantly restricts or prevents permeation of fuel vapors (e.g., diurnal emissions) while providing the resilient body 104 to enable proper operation (e.g., deflection or pumping) of the primer apparatus 100 in a wide range of ambient temperatures. A vehicle user may squeeze and release the body 104 of the primer apparatus 100 to purge air from and/or pressurize the fuel system 102 (e.g., a marine fuel system). As the body 104 is deflected and released, the volume of the inner chamber 106 is varied (e.g., decreased and increased) to provide a vacuum to draw fluid (e.g., fuel) from the fuel tank 110 (e.g., an upstream source) fluidly coupled to the inlet 108 and the inner chamber 106 provides fluid to the downstream equipment 114 (e.g., an engine) fluidly coupled to the outlet 112, thereby purging the fuel system 102 of air and/or pressurizing the fuel system 102.

The first layer material 120 of the body 104 substantially prevents permeation of fuel vapor (e.g., diurnal emissions) traveling within the fuel system 102. For example, the primer apparatus 100 provides a fuel vapor permeation rate of less than about 15 g/m$^2$/day at approximately 73° F. (+/−4° F.). Additionally, the second layer material 122 provides strength and/or structure for the first layer material 120 and substantially resists ozone attack, UV, etc. The second layer material 122 also provides a relatively high resiliency that prevents the body 104 from loosing spring back or flexibility when the primer apparatus 100 is exposed to temperature fluctuations and/or after repeated deflections by a user. Thus, the second layer material 122 prevents the first layer material 120 from deforming or setting when the body 104 is repeatedly deflected by a user.

Figure 2A:
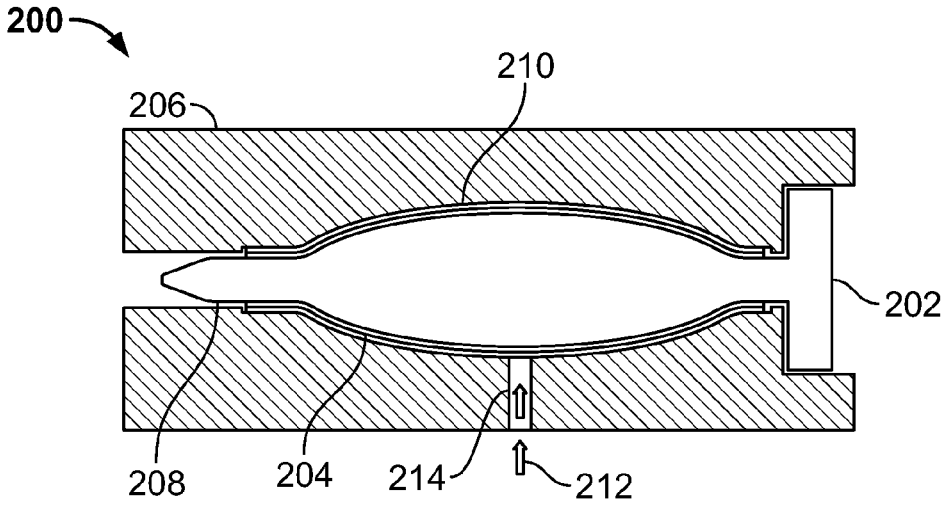
FIGS. 2A-2C are schematic illustrations of an example process to form the example primer apparatus of FIGS. 1A and 1B FIGS. 3A-3D are schematic illustrations of another example process to form the example primer apparatus of FIGS. 1A and 1B.
Figure 2B:
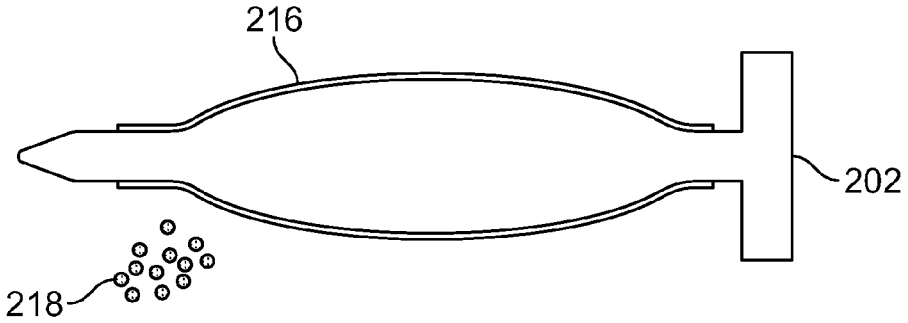
Figure 2C:
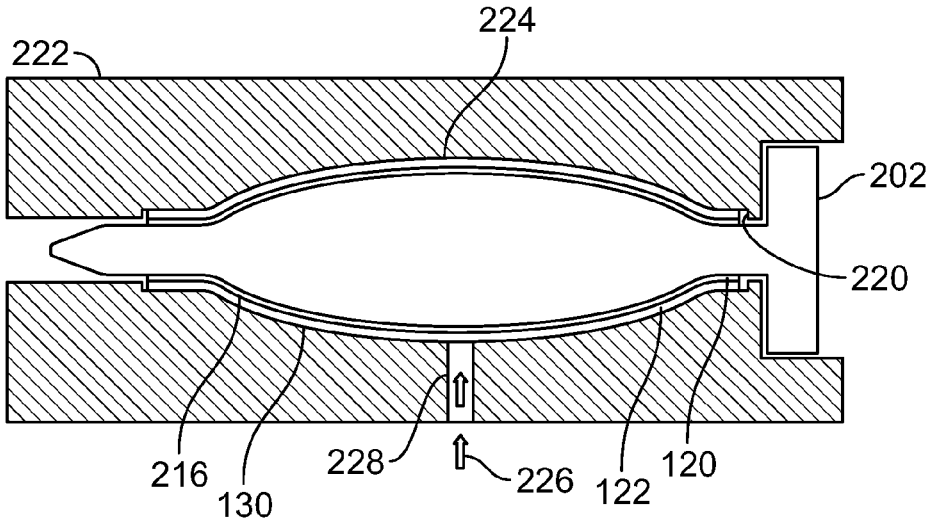
Figures 3A, 3B, 3C, 3D:
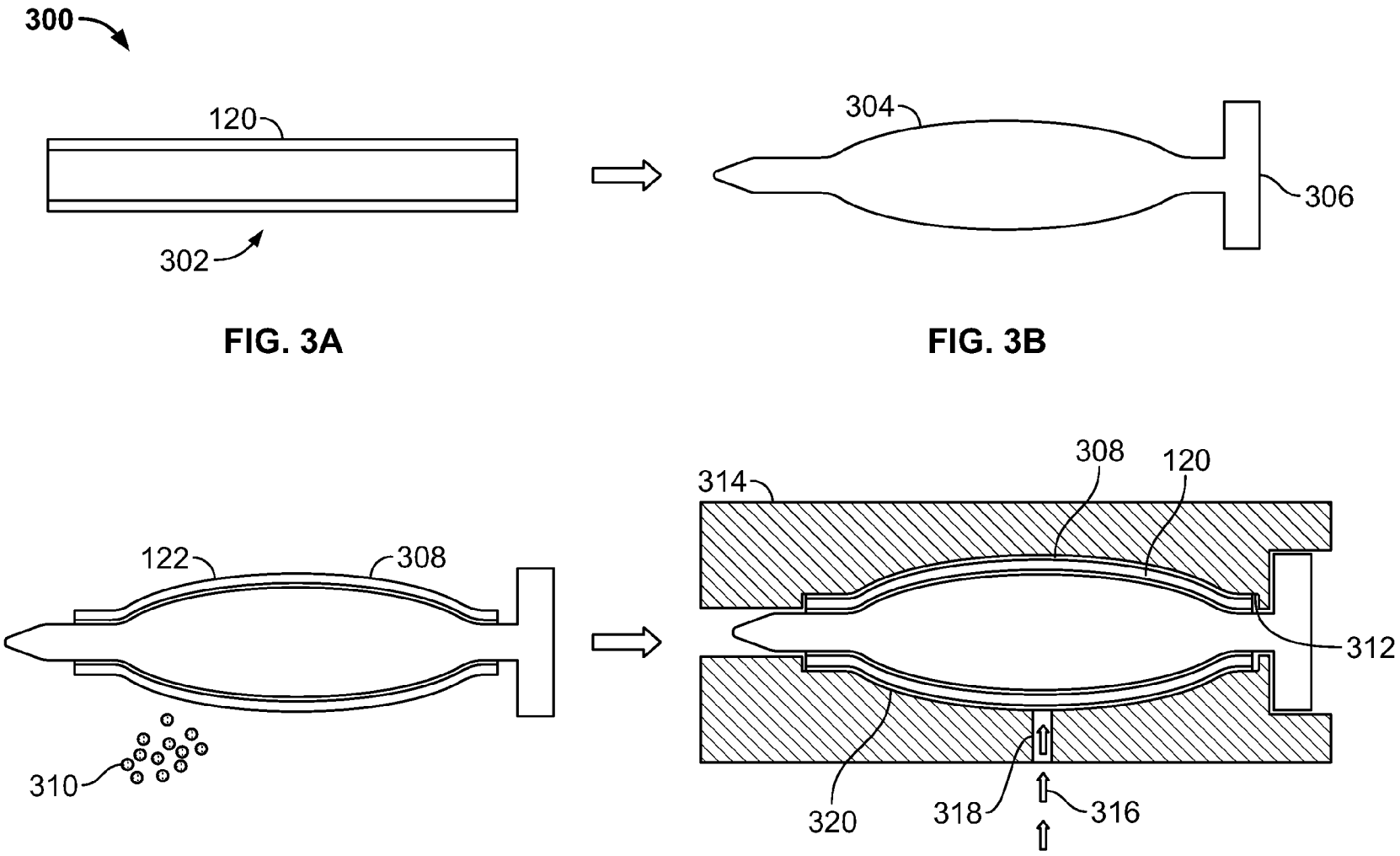

FIGS. 2A-2C illustrate an example method 200 of manufacturing or forming the primer apparatus of 100 of FIG. 1. In this example, a core 202 (e.g., a metal core) is disposed within a cavity 204 of a first mold apparatus 206. The core 202 includes an outer surface 208 having a shape that defines the inner chamber 106 of the primer apparatus 100. Thus, the size of the outer surface 208 of the core 202 defines the volumetric size of the inner chamber 106. Also, the core 202 defines a cross-sectional shape of the primer apparatus 100. An annular area or distance between an inner surface 210 of the cavity 204 and the outer surface 208 of the core 202 defines the thickness 124 of the first layer material 120. With the core 202 disposed within the cavity 204, the first layer material 120 is injected as molten material or liquid 212 (e.g., molten fluorocarbon material) within the cavity 204 via a port or sprue 214 of the first mold apparatus 206 and substantially fills the cavity 204 between the outer surface 208 of the core 202 and the inner surface 210 of the cavity 204. When cooled, the core 202 having the first layer material 120 is removed from the first mold apparatus 206.

Referring to FIG. 2B, after the core 202 is removed from the first mold apparatus 206, an outer surface 216 of the first layer material 120 may be coated with a bonding agent 218 via, for example a spraying device. The core 202, having the first layer material 120, is then disposed within a cavity 220 of a second mold apparatus 222. Similar to the first mold apparatus 206, the outer surface 216 of the first layer material 120 and an inner surface 224 of the cavity 220 define the thickness 126 of the second layer material 122. The second layer material 122 is injected as molten material 226 (e.g., molten Nitrile polymer) within the cavity 220 via a sprue 228 and substantially fills the cavity 220 between the outer surface 216 of the first layer material 120 and the inner surface 224 of the cavity 220. When cooled, the molten material 226 hardens or solidifies into the second layer material 122. As the molten material 226 cools, the bonding agent 218 causes a chemical reaction to enable the second layer material 122 to bond or adhere to the first layer material 120. The core 202 is removed from the second mold apparatus 222, and the primer apparatus 100 is removed from the core 202. Although not shown for clarity, the cavity 220 may include a cavity or groove to form or define the rib(s) 128 and/or the rib(s) 134 on the outer surface 130 of the second layer material 122.

FIGS. 3A-3D illustrates another example method 300 of manufacturing or forming the example primer apparatus 100 of FIG. 1. In this example, the first layer material 120 is coextruded in the shape or form of, for example, a tubular member 302. The tubular member 302 is slip-fit over an outer surface 304 of a core 306 (e.g., either manually or via a press). When the first layer material 120 is slip-fit over the core 304, an outer surface 308 of the first layer material 120 is provided with a bonding agent 310 via, for example, a sprayer. When the first layer material 120 is sprayed or coated with the bonding agent 310, the core 304 is disposed within a cavity 312 of a mold apparatus 314. The second layer material 122 is injected as molten liquid 316 within the mold apparatus 314 via a sprue 318 and substantially fills the cavity 312 between the outer surface 308 of the first layer material 120 and an inner surface 320 of the cavity 312. The mold apparatus 314 is then cooled to enable the molten liquid 316 to harden or solidify to form the second layer material 122. As the material 316 cools, the bonding agent 310 causes a chemical reaction between the first and second layer materials 120 and 122 to cause the second layer material 122 to bond or adhere to the first layer material 120. After the second layer material 122 is cooled, the core 304 is removed from the mold apparatus 314 and the primer apparatus 100 is removed or slipped off of the core.

In other examples, the first layer material 120 may be integrally formed with, coupled to, embedded within, and/or disposed within the second layer material 122 via, for example, blow molding, rotational molding, insert molding, and/or any other suitable manufacturing process(es). For example, a first layer material composed of nylon may be formed via blow molding and a second layer material composed of rubber may be over molded with the first layer material to form an example primer apparatus described herein. Additionally or alternatively, any number of layers of the first layer material 120 and/or the second layer material 122 may be used to form the body of the primer apparatus 100. For example, a layer composed of the first layer material 120 having low permeation characteristics may be disposed between two layers composed of the second layer material 122 having a relatively high resiliency. In other examples, the primer apparatus 100 may include a plurality of layers composed of the first layer material 120 coupled to, embedded with, and/or disposed between a plurality of layers composed of the second layer material 122.

Figure 4:
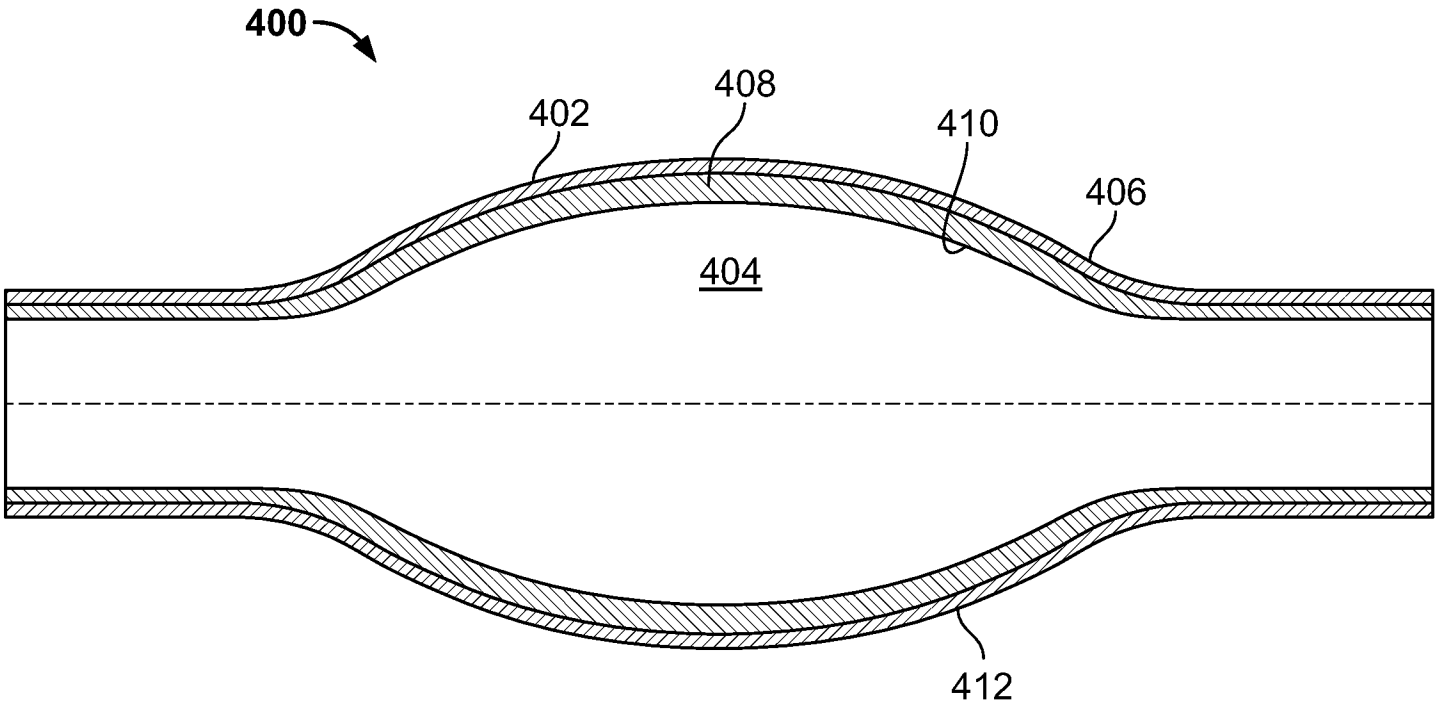
FIG. 4 illustrates a cross-sectional view of another example primer apparatus described herein.

FIG. 4 illustrates another example primer apparatus 400 described herein. As shown in FIG. 4, the example primer apparatus 400 includes a body 402 having an inner chamber 404. The body 402 includes a first or outer layer 406 composed of a material having low permeation characteristics and a second or inner layer 408 composed of a material having relatively high strength and/or resiliency. As shown, the first layer 406 substantially surrounds the second layer 408 and the second layer 408 defines an inner surface 410 of the chamber 404 of the primer apparatus 400. The first layer 406 may include, but is not limited to, a fluoroelastomer material (e.g., a Fluorocarbon (FKM)), a fluoropolymer material (e.g., polytetrafluoroethylene), a nylon material, Acetal, a copolymer material (e.g., Ethylene Vinyl Alcohol) or any other material providing relatively low permeation characteristics (e.g., a permeation rate less than about 15 $g/m^2$/day when exposed to temperatures between about 69° F. and 77° F.). The second layer 408, for example, may include, but is not limited to, a halogenated elastomeric material such as ECO, a Nitrile material, a rubber material, a plastic material, or any other material that provides relatively high strength and/or resiliency. Although not shown, the first layer 406 may include at least one rib disposed on an outer surface 412 of the body 402 to provide structural support to the body 402. The first layer 406 may be integrally formed with, coupled to, embedded within, and/or disposed within the second layer 408 via any suitable manufacturing processes such as, for example, the manufacturing processes described herein. In other examples, the example primer apparatus 400 may include a plurality of first layers 406 and/or a plurality of second layers 408 that may be coupled to, embedded with, or disposed between the other of the plurality of first layers 406 and/or the plurality of second layers 408.

Figure 5:
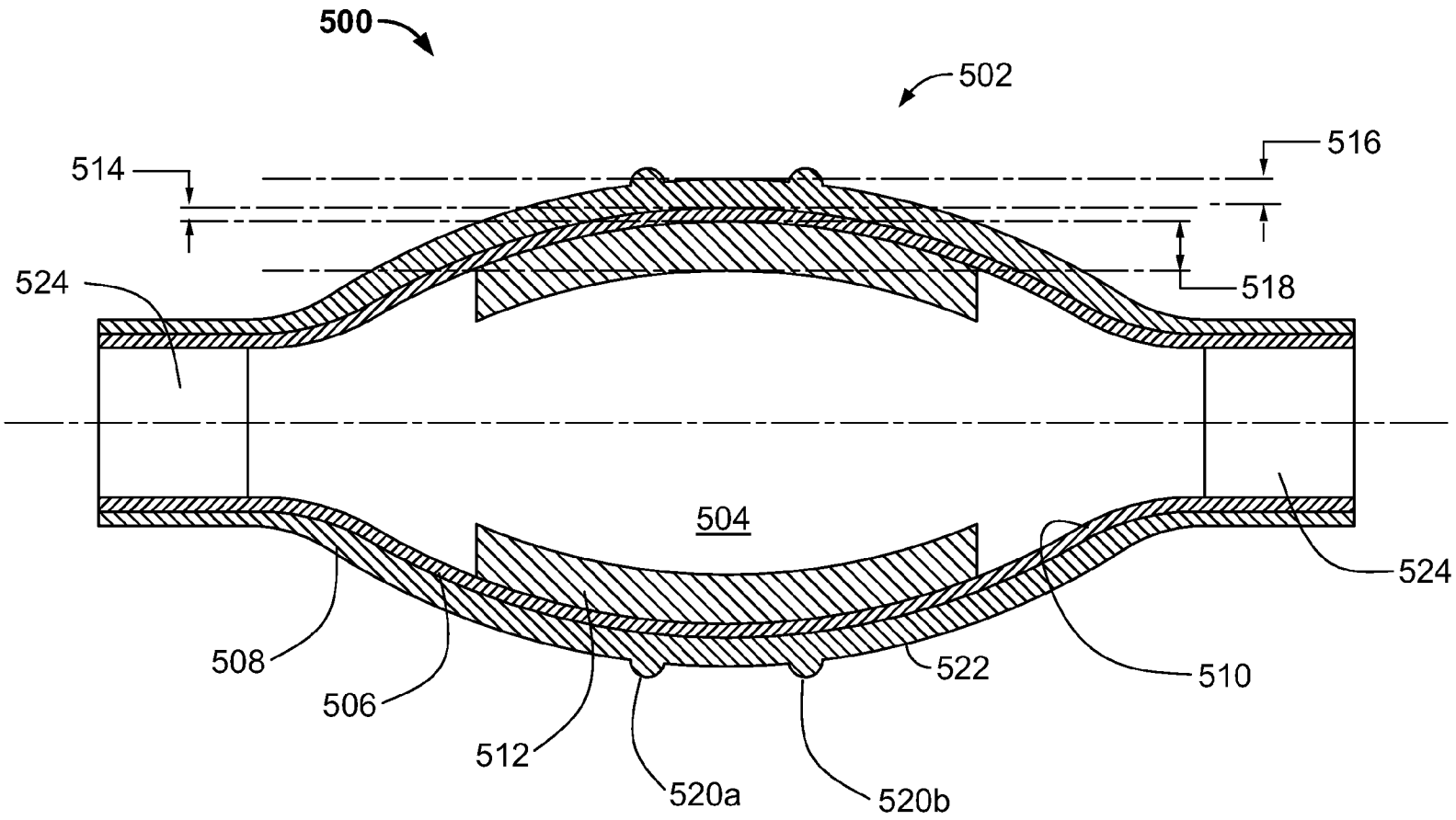
FIG. 5 illustrates a cross-sectional view of another example primer apparatus described herein.

FIG. 5 illustrates a cross-sectional view of another example primer apparatus 500. As shown in FIG. 5, the example primer apparatus 500 includes a body 502 having an inner chamber or cavity 504. The primer apparatus 500 includes an inner layer or membrane 506 composed of a material having low permeation characteristics to substantially prevent diurnal emissions from escaping from the inner chamber or cavity 504 and/or through the body 502. The primer apparatus 500 also includes an outer layer or casing 508 composed of a material having relatively high strength and/or resiliency compared to the membrane 506 to enable the primer apparatus 500 to return to an uncompressed (e.g., undeflected) shape when the primer apparatus 500 is deflected and released by a user. As shown, the casing 508 substantially surrounds the membrane 506 and the membrane 506 defines an inner surface 510 of the chamber or cavity 504 of the primer apparatus 500.

Additionally, as shown in FIG. 5, the example primer apparatus 500 includes a third layer, body or insert 512 having a relatively high resiliency compared to the membrane 506 to force or urge (e.g., together with the casing 508) the membrane 506 and the casing 508 outward to the primer apparatus 500 to its uncompressed (e.g., undeflected) shape when the primer apparatus 500 is deflected and released by the user. The insert 512 is adjacent to the inner surface 510 of the chamber or cavity 504 such that at least a portion of the membrane 506 is captured between the casing 508 and the insert 512.

The membrane 506 may include, but is not limited to, a fluoroelastomer material (e.g., a Fluorocarbon (FKM)), a fluoropolymer material (e.g., polytetrafluoroethylene), a nylon material, Acetal, a copolymer material (e.g., Ethylene Vinyl Alcohol) or any other material providing relatively low permeation characteristics (e.g., a permeation rate less than about 15 $g/m^2$/day when exposed to temperatures between about 69° F. and 77° F.). The casing 508, for example, may include, but is not limited to, a halogenated elastomeric material such as ECO, a Nitrile material, a rubber material, a plastic material, or any other material that provides relatively high strength and/or resiliency. The insert 512, for example, may include, but is not limited to, a halogenated elastomeric material such as ECO, a Nitrile material, a rubber material, a plastic material, or any other material that provides relatively high strength and/or resiliency. The membrane 506 may have a thickness 514 of between about 0.050 inches and 0.080 inches, the casing 508 may have a thickness 516 of between about 0.080 inches and 0.180 inches, and the insert 512 may have a thickness 518 of between about 0.100 inches and 0.180 inches. The casing 508 and the insert 512 should each have a thickness that enables the example primer apparatus 500 to return to its undeflected shape when deflected and released by the user. In other words, the casing 508 and the insert 512 should not be so thin that when the primer apparatus 500 is deflected and released by the user, the primer apparatus 500 remains deflected and/or collapsed. Also, the membrane 506 should be of a thickness that adequately prevents and/or restricts permeation of fuel vapors. The above-noted thicknesses are merely examples and other thicknesses may be used to suit the needs of a particular application.

To provide additional structural support and/or strength to the example primer apparatus 500, the body 502 may include at least one rib 520 disposed on an outer surface 522 of the body 502 (i.e., an outer surface of the casing 508). As shown, the example body 502 includes two ribs 520*a* and 520*b*. However, any other number of ribs may be used.

The membrane 506 may be secured between the casing 508 and the insert 512 using an interference fit. The insert 512 holds the first layer or membrane 506 against the casing 508 when the primer apparatus 500 is deflected and released by the user and, thus, ensures that the membrane 506 substantially retains its shape. Additionally or alternatively, the membrane 506 and the casing 508 may be secured at opposing ends of the body 502 using check valves 524. The check valves 524 may be pressed into the end of the body 502 to further capture the membrane 506 between the casing 508 and the check valves 524.

Although certain apparatus, methods, and articles of manufacture have been described herein, the scope of coverage of this patent is not limited thereto. To the contrary, this patent covers all apparatus, methods, and articles of manufacture fairly falling within the scope of the appended claims either literally or under the doctrine of equivalents.

I claim:

1. A multi-layer primer apparatus, comprising:

a flexible body defining an internal chamber to be fluidly coupled to a fuel system, the body comprising:

a first layer material having a low permeation characteristic to substantially prevent diurnal emissions from escaping through the body;

a second layer material adjacent to the first layer material and having a relatively high resiliency compared to the first layer material to enable the body to return to an uncompressed shape when the body is deflected and released by a user; and a third layer material adjacent to the first layer material such that the first layer material is disposed between the second layer material and the third layer material and having a relatively high resiliency compared to the first layer material to enable the body to return to the uncompressed shape when the body is deflected and released by the user.

2. The primer apparatus of claim 1, wherein the first layer material comprises a fluorocarbon-based material.

3. The primer apparatus of claim 1, wherein the second layer material comprises rubber.

4. The primer apparatus of claim 1, wherein the third layer material comprises rubber.

5. The primer apparatus of claim 1, wherein the second layer material completely surrounds the first layer material.

6. The primer apparatus of claim 1, wherein the first layer material is secured between the second layer material and the third layer material using an interference fit.

7. The primer apparatus of claim 1, wherein the first and second layer materials are secured at opposing ends of the body using check valves.

8. The primer apparatus of claim 1, wherein the first layer material is shaped to define an inner chamber of the primer apparatus.

9. The primer apparatus of claim 1, further comprising at least one rib disposed on an outer surface of the body.

10. The primer apparatus of claim 1, wherein a thickness of the first layer material is between about 0.05 inches and 0.08 inches.

11. The primer apparatus of claim 1, wherein a thickness of the second layer material is between about 0.08 inches and 0.18 inches.

12. The primer apparatus of claim 1, wherein a thickness of the third layer material is between about 0.10 inches and 0.18 inches.

13. A multi-layer primer apparatus, comprising:

a membrane to substantially prevent diurnal emissions from escaping from a cavity within the primer apparatus;

a casing coupled to an outer surface of the membrane such that at least a portion of the membrane defines a collapsible portion of the cavity; and a body positioned within a collapsible portion of the cavity, the body engaging an inner surface of the portion of the membrane defining the collapsible portion of the cavity when the primer apparatus is in a non-deflected state, the body to flex when the primer apparatus is deflected.

14. The primer apparatus of claim 13, wherein the membrane comprises a fluorocarbon-based material.

15. The primer apparatus of claim 13, wherein the casing comprises rubber.

16. The primer apparatus of claim 13, wherein the body comprises rubber.

17. The primer apparatus of claim 13, wherein the casing completely surrounds the membrane.

18. The primer apparatus of claim 13, wherein the membrane is secured between the casing and the body using an interference fit.

19. The primer apparatus of claim 13, wherein the membrane and the casing are secured at opposing ends of the primer apparatus using check valves.

20. A multi-layer primer apparatus, comprising:

a flexible body defining an internal chamber to be fluidly coupled to a fuel system, the body comprising:

a first material having a low permeation characteristic to substantially prevent diurnal emissions from escaping through the body;

a second material adjacent the first material and having a relatively high resiliency compared to the first material to enable the body to return to an uncompressed shape when the body is deflected and released by a user; and a flexible insert to be contained in the body such that the first material is disposed between the second material and the flexible insert and having a relatively high resiliency compared to the first material to hold the first material against the second material when the body is deflected and released by the user.

21. The primer apparatus of claim 20, wherein the first material comprises a fluorocarbon-based material.

22. The primer apparatus of claim 20, wherein the second material comprises rubber.

23. The primer apparatus of claim 20, wherein the flexible insert comprises rubber.

24. The primer apparatus of claim 20, wherein the second material completely surrounds the first material.

25. The primer apparatus of claim 20, wherein the first and second materials are secured at opposing ends of the body using check valves.

26. The primer apparatus of claim 20, wherein the first material is shaped to define an inner chamber of the primer apparatus.

27. A multi-layer primer apparatus, comprising:

a membrane to substantially prevent diurnal emissions from escaping from a cavity within the primer apparatus:

a casing coupled to an outer surface of the membrane: and a body coupled to an inner surface of the membrane to form at least a portion of the cavity, the body to flex when the primer apparatus is deflected, the body urging the membrane to an undeflected position after the primer apparatus is deflected and released.

28. The primer apparatus of claim 13, wherein the body is positioned between respective ends of the membrane.

29. A multi-layer primer apparatus, comprising:

a membrane to substantially prevent diurnal emissions from escaping from a cavity within the primer apparatus;

a casing coupled to an outer surface of the membrane; and a body coupled to an inner surface of the membrane to form at least a portion of the cavity, the body to flex when the primer apparatus is deflected, wherein the body has a relatively high resiliency compared to the membrane to urge, together with the casing, the membrane and the casing outward to an undeflected position after the primer apparatus is deflected and released.

30. A multi-layer primer apparatus, comprising:

a membrane to substantially prevent diurnal emissions from escaping from a cavity within the primer apparatus;

a casing coupled to an outer surface of the membrane; and a body coupled to an inner surface of the membrane to form at least a portion of the cavity, the body to flex when the primer apparatus is deflected, wherein the body provides an outward force to the membrane and the casing when the primer apparatus is released.

* * * * *